US012134951B2

(12) United States Patent
Reese et al.

(10) Patent No.: US 12,134,951 B2
(45) Date of Patent: Nov. 5, 2024

(54) SYSTEM AND METHOD FOR LATERAL CEMENTING OPERATION

(71) Applicant: Devon Energy Corporation, Oklahoma City, OK (US)

(72) Inventors: Isaac Reese, Edmond, OK (US); Sam Goswick, Oklahoma City, OK (US)

(73) Assignee: Devon Energy Corporation, Oklahoma City, OK (US)

( * ) Notice: Subject to any disclaimer, the term of this patent is extended or adjusted under 35 U.S.C. 154(b) by 76 days.

(21) Appl. No.: 17/624,195

(22) PCT Filed: Jul. 3, 2020

(86) PCT No.: PCT/US2020/040817
§ 371 (c)(1),
(2) Date: Dec. 30, 2021

(87) PCT Pub. No.: WO2021/003466
PCT Pub. Date: Jan. 7, 2021

(65) Prior Publication Data

US 2022/0372840 A1 Nov. 24, 2022

Related U.S. Application Data

(60) Provisional application No. 62/870,652, filed on Jul. 3, 2019.

(51) Int. Cl.
*E21B 33/14* (2006.01)
*E21B 23/01* (2006.01)
*E21B 41/00* (2006.01)

(52) U.S. Cl.
CPC ..... *E21B 33/14* (2013.01); *E21B 23/01* (2013.01); *E21B 41/00* (2013.01)

(58) Field of Classification Search
CPC ..... E21B 33/16
See application file for complete search history.

(56) References Cited

U.S. PATENT DOCUMENTS

| | | | | |
|---|---|---|---|---|
| 6,311,774 | B1 | 11/2001 | Brockman et al. | |
| 2006/0000993 | A1 | 1/2006 | Kirk et al. | |
| 2010/0039879 | A1 | 2/2010 | Buytaert | |
| 2012/0279705 | A1 | 11/2012 | Moffitt et al. | |
| 2013/0118752 | A1* | 5/2013 | Hannegan | E21B 47/001 166/336 |
| 2016/0177637 | A1* | 6/2016 | Fleckenstein | E21B 17/22 166/380 |
| 2020/0003019 | A1* | 1/2020 | Ali | E21B 23/02 |

OTHER PUBLICATIONS

ISA/US; Int'l Search Report for PCT/US2020/040817; Mailed Sep. 10, 2020.
ISA/US; Written Opinion for PCT/US2020/040817; Mailed Sep. 10, 2020.

* cited by examiner

*Primary Examiner* — William D Hutton, Jr.
*Assistant Examiner* — Avi T Skaist
(74) *Attorney, Agent, or Firm* — Crowe & Dunlevy, P.C.

(57) ABSTRACT

In an exemplary embodiment, the present invention includes a casing rotation system for use in connection with a well that has a casing deployed inside a wellbore, in which the casing a shoe track and a production section with a rotatable portion. The casing rotation system has a swivel connected to an uphole end of the rotatable portion of the production section, and a motor connected to the rotatable section of the production section. The motor is configured to rotate the rotatable section of the production section.

14 Claims, 3 Drawing Sheets

SYSTEM AND METHOD FOR LATERAL CEMENTING OPERATION

RELATED APPLICATIONS

This application claims the benefit of U.S. Provisional Patent Application Ser. No. 62/870,652 filed Jul. 3, 2019, entitled, "System and Method for Lateral Cementing Operation," the disclosure of which is herein incorporated by reference.

FIELD OF THE INVENTION

This invention relates generally to the field of oil and gas production and more particularly, but not by way of limitation, to processes for cementing casing within a drilled well.

BACKGROUND

Well cementing is the process of introducing cement to the annular space between the casing and the wellbore of a subterranean well. Cementing supports the casing within the wellbore and isolates producing and non-producing zones to maximize the recovery of hydrocarbons from the well and comply with government regulations. In most cases, a cement slurry is pumped through the casing from the surface through a cementing head. The cement slurry is pushed through the open end of the casing and is recirculated back through the annular space between the outside of the casing and the wellbore. The cement seals the casing within the wellbore to prevent unwanted migration of fluids from the various geologic formations along the outside of the casing. Proper zonal isolation is particularly important in modern completion processes that may involve hydraulic fracturing operations at multiple locations along the wellbore and casing.

An important aspect of the cementing process is ensuring that there is an adequate bond between the cement and the casing. Cement bond logs may be obtained to measure and evaluate the integrity of the cement work performed on the well. If the cement does not properly adhere to the outside of the casing, or if voids are formed between the casing and the cement, the integrity of the cement job may be compromised. This may lead to the inter-zonal transmission of high pressure fluids in the annular space around the casing.

To increase adhesion of the cement to the casing, the casing may be rotated during the cement job using a rotating cement head and applying torque to the string using the top drive, a casing running tool (CRT), or the rotary table while simultaneously pumping through the rotating cement head. Although rotating the casing works well in relatively shallow vertical wells, the casing is difficult to rotate in some wells, including wells with deviated wellbores such as horizontal, S-curve, and slant wells. In these demanding applications, the amount of torque needed to rotate the casing can result in excessive torsional forces that may damage the casing.

Furthermore, the problems associated with poorly bonded cement are exacerbated in horizontal wellbores. One of the specific challenges of horizontal casing cement jobs is low-side cement isolation, contamination, and cement thickness consistency. The volume between the casing and wellbore may contain voids, contaminated cement, or fissures that extend along the laterally disposed casing as a result of these challenges. Therefore, a need exists for an improved system and method for cementing a well with a lateral portion that overcomes these and other deficiencies of the prior art.

SUMMARY OF THE INVENTION

In an exemplary embodiment, the present invention includes a casing rotation system for use in connection with a well that has a casing deployed inside a wellbore, in which the casing a shoe track and a production section with a rotatable portion. The casing rotation system has a swivel connected to an uphole end of the rotatable portion of the production section, and a motor connected to the rotatable section of the production section. The motor is configured to rotate the rotatable section of the production section.

In another embodiment, the present invention includes a casing rotation system for use in connection with a well that has a casing deployed inside a wellbore, in which the casing a shoe track and a production section with a rotatable portion. The casing rotation system includes a swivel uphole from the section of casing desired to be rotated, and a finned casing section connected downhole from the rotatable portion of the production section. The finned casing section includes a plurality of internal fins that are configured to induce a rotation in the rotatable portion of the production section when fluids are pumped through the finned casing section.

In yet another embodiment, the present invention includes a method for conducting a cementing operation on a casing within a wellbore. The method includes the steps of connecting a shoe track to a rotatable portion of a production section of the casing, connecting the rotatable portion of the production section of the casing to a downhole side of a swivel and connecting a non-rotatable portion of the production section of the casing to an uphole side of the swivel. The method next includes the steps of placing the casing inside the wellbore and rotating the rotatable portion of the production section of the casing inside the wellbore. The method includes the step of pumping cement through the casing into an annulus between the casing and the wellbore as the rotatable portion of the production section is rotating.

WRITTEN DESCRIPTION

Figure 1:
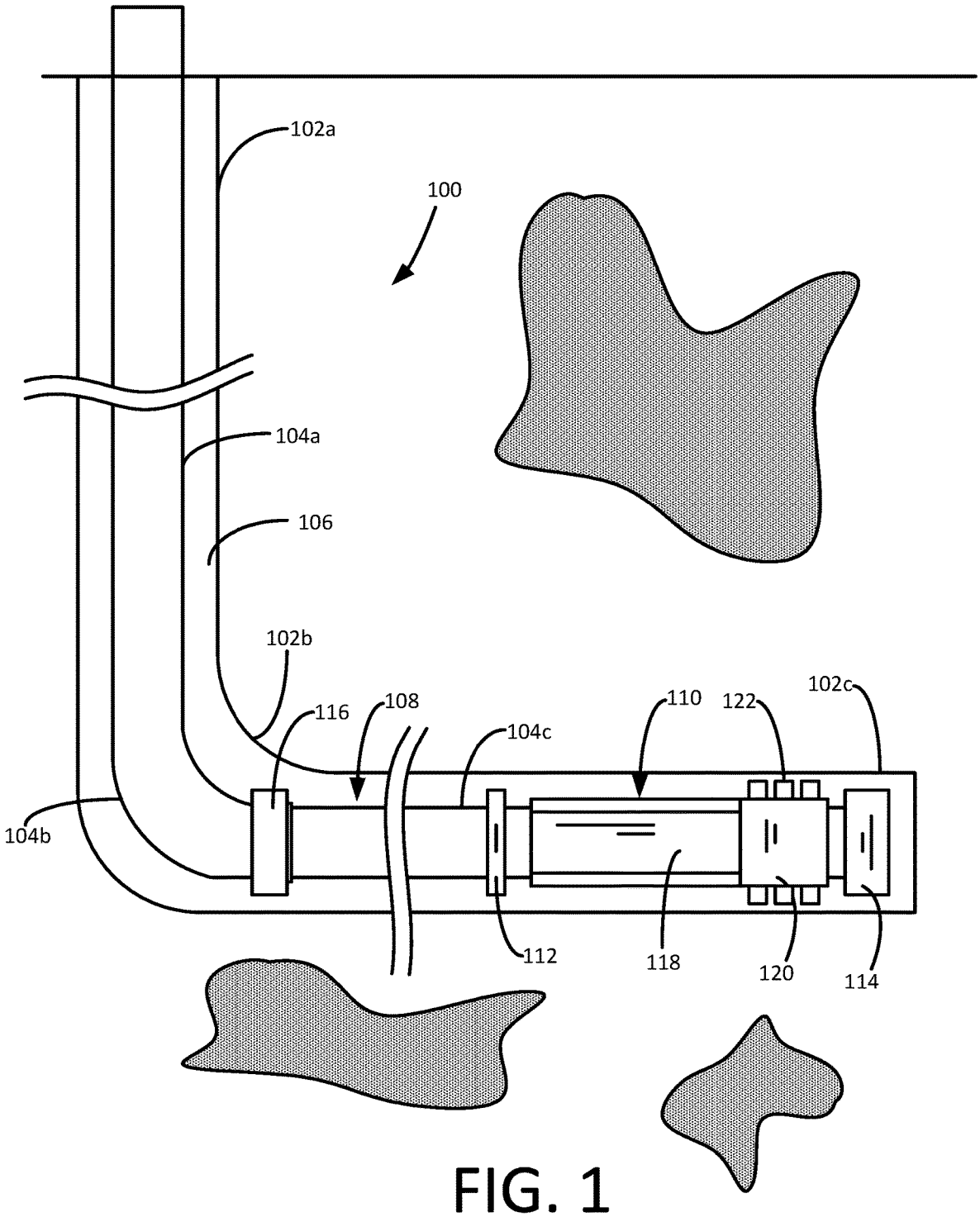
FIG. 1 is a depiction of a first embodiment of a well cementing system.

FIG. 1 is a depiction of a well 100 that includes a wellbore 102 and casing 104 located inside the wellbore 102. The wellbore 102 includes a vertical portion 102*a*, a heel or curve portion 102*b* and a lateral portion 102*c*. In certain wells 100, the lateral portion 102*c* may include undulations or may be inclined or declined from horizontal. The casing 104 also includes a vertical portion 104*a*, a heel or curve portion 104*b* and lateral portion 104*c*. It will be appreciated that the casing 104 may be constructed from numerous joints that are interconnected. The diameter and thickness of the casing 104 may vary from the top of the well 100 to the bottom of the well 100. An annulus 106 extends between the outside of the casing 104 and the wall of the wellbore 102. The well 100 can be drilled for the production of hydrocarbons, thermal, minerals, water of other subterranean resources. Although the well 100 is depicted as having a lateral wellbore 102*c*, the systems and methods disclosed herein may also find utility in any wellbore geometric configuration, including, but not limited to, vertical, S-curve, deviated, slant, and horizontal geometries.

As used herein, the term "uphole" is a relative positional or directional reference that refers to a component or process in the wellbore 100 that is nearer to the surface. In contrast, "downhole" refers to a component or process in the wellbore 100 that is farther or deeper within the wellbore 100. With this nomenclature, the lateral portion of the wellbore 102*c* is downhole from the vertical portion of the wellbore 102*a*. The vertical portion of the wellbore 102*a* is uphole from the lateral portion of the wellbore 102*c*.

Figures 2, 3:
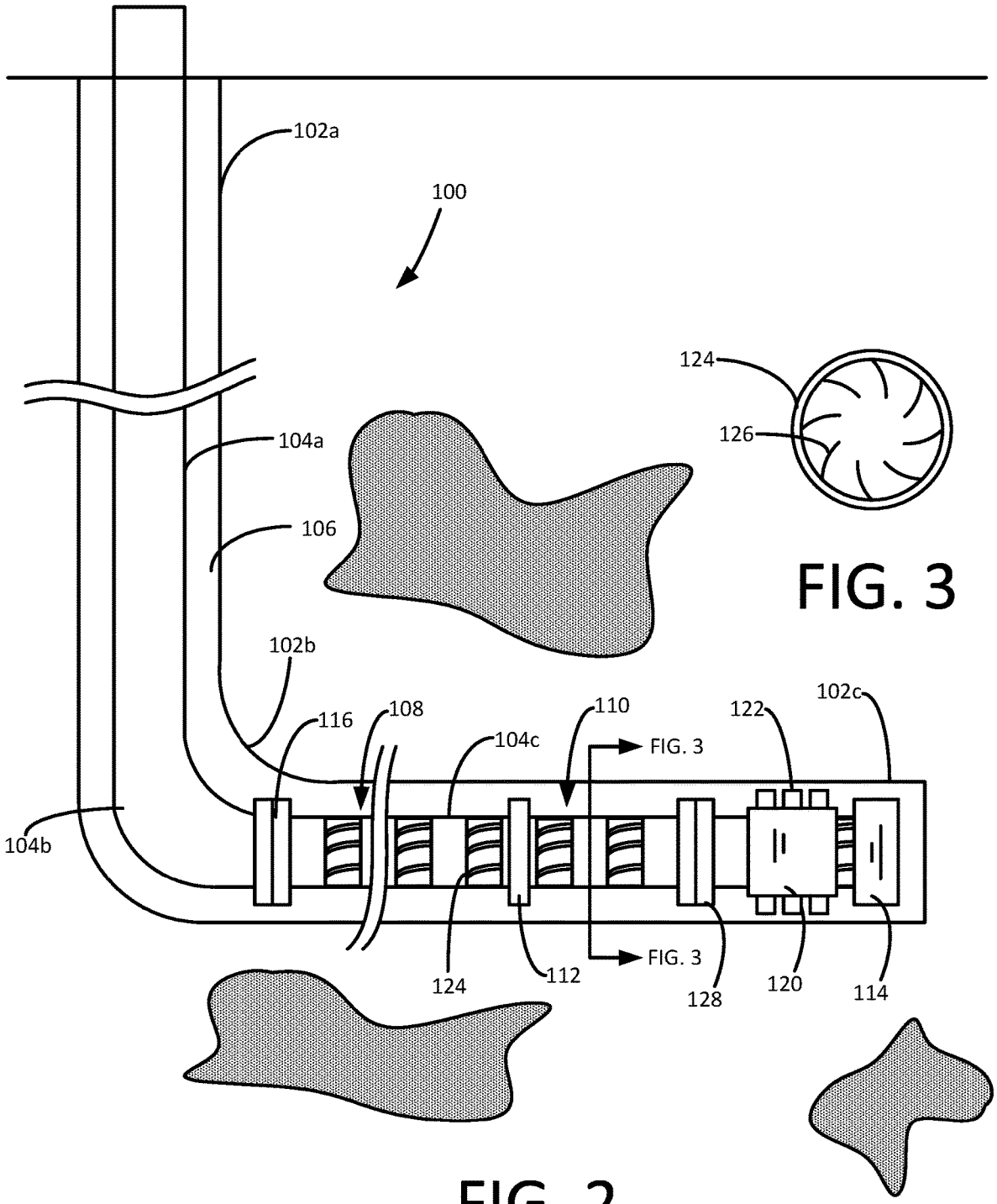
FIG. 2 is a depiction of a second embodiment of a well cementing system.
FIG. 3 is a cross-sectional view of the finned casing from the motor of the well cementing system of FIG. 2.

In the lateral portion 102*c*, the casing 104 generally includes a production section 108 and a shoe track 110 (not shown to scale in FIGS. 1 and 2). The production section 108 may extend for thousands of feet through producing areas of the surrounding geologic formations. Once the well 100 has been completed, the production section 108 may include a plurality of separate zones that control the production of fluids from the well 100. The shoe track 110 is primarily used during the cementing process. The shoe track 110 used in this system is designed to circulate cement through the annulus 106 and to anchor the casing 104 to the formation surrounding the wellbore 102.

The shoe track 110 extends between a float collar 112 and a float shoe 114. The float collar 112 and the float shoe 114 ensure that the flow path of the cement during the cement job is confined to a single direction, most often only allowing cement to flow from the casing 104 to the annulus 106, and preventing flow from the annulus 106 into the casing 104. Following the cementing job, the shoe track 110 may be partially or completely full of cement.

In the embodiment depicted in FIG. 1, the casing 104 includes a swivel 116, a hydraulic motor 118 such as a positive displacement motor (PDM) or a turbine, and an optional anchor 120. The swivel 116 is secured between the heel or curve portion of the casing 104*b* and the lateral portion of the casing 104*c*. The swivel 116 provides a sealed connection between the adjacent sections of the casing 104 that allows the lateral portion of the casing 104*c* to rotate while the heel portion of the casing 104*b* and vertical portion of the casing 104*a* remain stationary. Although FIG. 1 depicts the swivel 116 between the heel and the lateral, this portion of the system can be placed anywhere in the casing string.

The anchor 120 is connected near the distal end of the lateral portion of the casing 104*c* in proximity to the float shoe 114. The anchor 120 includes one or more extensible members 122 that engage the surrounding wellbore 102 to lock the anchor 120 and casing 104 in a stationary position within the wellbore 102. The extensible members 122 can be rods, posts, teeth or other projections that deploy radially outward from the anchor 120. In some embodiments, the anchor 120 is pressure activated and the extensible members 122 deploy in response to the application of fluid pressure above a threshold value. In other embodiments, the anchor 120 is activated by a pumped activator (e.g., ball) that causes the extensible members 122 to deploy when the pumped activator is present in the anchor 120. In yet another embodiment, the anchor 120 is activated in response to a signal transmitted from the surface through acoustic, electric or RFID technologies. The extensible members 122 can be energized and deployed by hydraulic, pneumatic, explosive, or spring forces.

Figure 4:
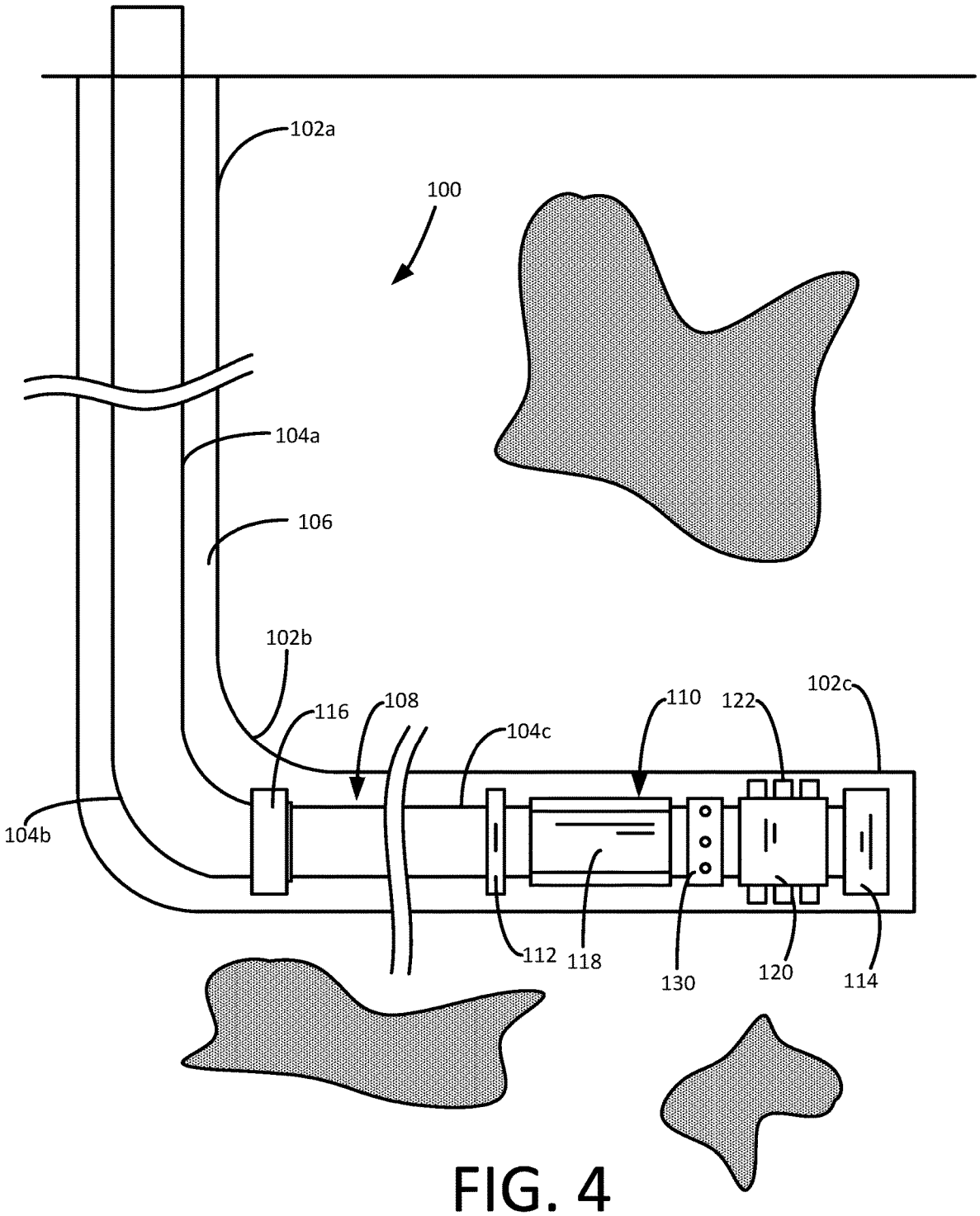
FIG. 4 is a depiction of a third embodiment of a well cementing system.

Notably, the anchor 120 permits the flow of fluid from the casing 104 to pass through the anchor 120 to the float shoe 114, where it is expelled into the annulus 106. In alternative embodiments depicted in FIG. 4, deploying the extensible members 122 would cause the flow path through the float shoe 114 to be closed off. The cement flow would then be diverted to the annulus 106 prior to the anchor 120 through a diverter sub 130 which may include a burst disk port or fluted sleeve that opens under a selected pressure to expel cement into the annulus 106.

The motor 118 is connected within the shoe track 110 of the casing 104. In exemplary embodiments, the motor 118 is a progressive cavity, positive displacement "mud motor" or "Moineau motor" that includes one or more rotors configured for rotation within one or more fixed stators (not separately designated). The rotor is forced into rotation by the admission of pressurized fluid or pressurized cement into the motor 118. In some embodiments, the stationary stator is fixed directly or indirectly to the anchor 120 and the rotor is fixed to the uphole casing 104. As pressurized cement passes into the motor 118, the rotor induces a rotation in the casing 104 between the motor 118 and the swivel 116. In other embodiments, the rotor is fixed directly or indirectly to the anchor and the stator is fixed to the uphole casing 104. In this variation, the stator is forced to rotate around a stationary rotor, thereby inducing a rotation in the portion of the casing 104 between the motor 118 and the swivel 116. In other embodiments, the positive displacement motor 118 can also be replaced by a turbine motor composed of a rotor with blades attached.

In the exemplary embodiment, during a cementing operation the high pressure cement passes through the motor 118 before exiting the casing 104 into the wellbore 102 through the anchor 120 and float shoe 114. The movement of the cement slurry through the motor 118 causes the production section 108 of the casing 104 to rotate. As the cement is circulated through the annulus 106, it passes outside of the rotating casing 104 to promote hole cleaning, isolation of the casing from the wellbore, isolation along the wellbore (hydraulic fracturing stimulation stage isolation), and to ensure proper adhesion and full circumferential and axial bonding of the cement to the casing 104. The rotation of the lateral portion of the casing 104*c* reduces the risk of creating voids or foreign inclusions in the cement in contact with the outside of the casing 104.

Turning to FIGS. 2 and 3, shown therein is a depiction of another embodiment in which the motor 118 has been replaced by a finned casing section 124. The finned casing section 124 includes a series of internal fin sets 126 (as best seen in FIG. 3) that are pitched and arranged such that the passage of pressurized fluids and cement through the finned casing section 124 generates a torque that induces a rotation in the finned casing section 124. In one variation, the fin sets 126 are constructed from a drillable material so that the fin sets 126 can be removed following the cementing job by driving a reamer through the inside of the finned casing section 124.

In another variation, the finned casing sections 124 are isolated to the shoe track 110. In another variation, the finned casing sections 124 are isolated to the production section 108. In yet another variation, the anchor 120 is connected near the end of the shoe track 110 and a second swivel 128 is positioned between the casing 104 and the anchor 120. In this embodiment, the anchor 120 is deployed at the outset of the cementing job. In yet another variation, the second swivel 128 is omitted, but the anchor 120 is not deployed until the cementing job is complete so that the anchor 120 is permitted to rotate with the finned casing section 124. In yet another embodiment, the anchor 120 is omitted entirely.

Thus, in a first embodiment, a casing rotation system includes the swivel 116, the motor 118 and the anchor 120. In a second embodiment, the casing rotation system includes the swivel 116 and the finned casing section 124. The second embodiment optionally includes the anchor 120 and optionally includes the second swivel 128. In each variation, the casing rotation system is configured to rotate at least the production section 108 of the casing 104 to improve the adherence and bonding of cement to the outside of the casing 104.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts and steps within the principles of the present invention to the full extent indicated by the broad general meaning of the terms in which the embodiments are expressed. It will be appreciated by those skilled in the art that the teachings of the present invention can be applied to other systems without departing from the scope and spirit of the present invention.

It is claimed:

1. A casing rotation system for use in connection with a well that has a casing deployed inside a wellbore, wherein the wellbore has a vertical portion and a lateral portion and wherein the casing comprises a shoe track and a production section within the lateral portion of the wellbore, the casing rotation system comprising:

a rotatable portion of the production section;

a swivel connected to an uphole end of the rotatable portion of the production section; and a motor connected to the rotatable portion of the production section, wherein the motor is located in the lateral portion of the wellbore and configured to rotate the rotatable portion of the production section.

2. The casing rotation system of claim 1, wherein the shoe track comprises an anchor downhole of the rotatable portion of the production section.

3. The casing rotation system of claim 2, wherein the motor is connected between the anchor and the rotatable portion of the production section.

4. The casing rotation system of claim 2, wherein the anchor comprises one or more extensible members that are selectively deployed to secure the anchor in a stationary position within the wellbore.

5. The casing rotation system of claim 4, wherein the shoe track comprises a float shoe downhole from the anchor.

6. The casing rotation system of claim 5, wherein the shoe track further comprises a float collar between the motor and the rotatable portion of the production section.

7. The casing rotation system of claim 6, wherein the motor is connected to the anchor.

8. The casing rotation system of claim 6, wherein the shoe track further comprises a diverter sub between the anchor and the motor.

9. A method for conducting a cementing operation on a casing within a wellbore, wherein the wellbore has a vertical portion and a lateral portion, the method comprising the steps of:

attaching a motor within a shoe track portion of the casing;

connecting the shoe track to a rotatable portion of a production section of the casing;

connecting the rotatable portion of the production section of the casing to a downhole side of a swivel;

connecting a non-rotatable portion of the production section of the casing to an uphole side of the swivel;

placing the casing inside the wellbore such that the rotatable portion of the production section of the casing and shoe track are located in the lateral portion of the wellbore;

activating the motor to rotate the rotatable portion of the production section of the casing inside the lateral portion of the wellbore; and pumping cement through the casing into an annulus between the casing and the wellbore as the rotatable portion of the production section is rotating.

10. The method of claim 9, further comprising the step of attaching an anchor within the shoe track and connecting the motor between the rotatable portion of the production section and the anchor.

11. The method of claim 10, further comprising the step of activating the anchor to deploy extensible members to lock the anchor in a stationary position within the wellbore.

12. The method of claim 9, further comprising the step of providing the rotatable portion of the production section with internal fins to induce a rotation of the rotatable portion as cement is pumped through the rotatable portion.

13. The method of claim 9, wherein the step of pumping cement through the casing precedes the step of activating the motor to rotate the rotatable portion of the production section.

14. The method of claim 13, wherein the step of activating the motor comprises pumping cement through the motor to force the rotation of the rotatable portion of the production section.

* * * * *